US007893615B2

(12) United States Patent
Cole

(10) Patent No.: US 7,893,615 B2
(45) Date of Patent: Feb. 22, 2011

(54) ULTRA VIOLET FLAME SENSOR WITH RUN-ON DETECTION

(75) Inventor: Barrett E. Cole, Bloomington, MN (US)

(73) Assignee: Honeywell International, Inc., Morristown, NJ (US)

( * ) Notice: Subject to any disclaimer, the term of this patent is extended or adjusted under 35 U.S.C. 154(b) by 769 days.

(21) Appl. No.: 11/901,656

(22) Filed: Sep. 18, 2007

(65) Prior Publication Data

US 2009/0072737 A1 Mar. 19, 2009

(51) Int. Cl.
*H01J 40/00* (2006.01)

(52) U.S. Cl. ..... 313/539; 250/372; 250/373

(58) Field of Classification Search ..... 313/359, 313/539; 250/372, 373
See application file for complete search history.

(56) References Cited

U.S. PATENT DOCUMENTS 5,548,277 A 8/1996 Wild
5,828,797 A 10/1998 Minott et al.
6,013,919 A 1/2000 Schneider et al.
7,088,253 B2 * 8/2006 Grow ..... 340/578
2007/0114264 A1 5/2007 Cole et al.
2008/0298934 A1 12/2008 Cole

* cited by examiner

*Primary Examiner*—Joseph L Williams
*Assistant Examiner*—Andrew J Coughlin
(74) *Attorney, Agent, or Firm*—Luis M. Ortiz; Kermit D. Lopez; Kris T. Fredrick

(57) ABSTRACT

A UV flame sensor for detecting a run-on condition in a flame detector tube is disclosed. The UV flame sensor comprises a pair of secondary electrodes that are enclosed in a mesotube to form a breakdown chamber in order to detect the run-on condition. These secondary electrodes are exposed to UV through an aperture in a cathode plate and are energized continuously by a lower voltage. The mesotube is expected to break down when the run-on condition occurs. The secondary electrodes can be placed in the same gas environment as the main electrodes that may take different forms, shapes and locations.

20 Claims, 4 Drawing Sheets

ULTRA VIOLET FLAME SENSOR WITH RUN-ON DETECTION

TECHNICAL FIELD

Embodiments are generally related to sensor methods and systems. Embodiments are also related to ultraviolet flame sensor for detecting run-on condition.

BACKGROUND OF THE INVENTION

Flame sensors are used to sense the presence or absence of a flame in a heater or burner, for example, or other apparatus. Flame detector systems are available to sense various attributes of a fire and to warn individuals when a fire is detected. For example, flame detector systems utilizing ultraviolet ("UV") sensors are known. In the flame detector system, UV radiation emitted from the flames of a fire is detected by the detector's UV sensor. When a sufficient amount of UV radiation is detected, the flame detector system goes into alarm to warn individuals of the flame.

Typically, the UV sensor can be constructed of a sealed UV glass tube with a pair of electrodes and a reactive gas enclosed therein. A constant voltage is typically applied across the UV sensor in order to adequately sense UV radiation. In the presence of UV radiation of a certain wavelength (typically in the range of 100-300 nm), the sensor discharges the voltage to indicate detection of UV radiation. After the UV sensor discharges, the voltage across the sensor must be refreshed to allow the sensor to continue to detect UV radiation. Typically, once a UV sensor discharges, it is refreshed at a periodic interval.

The performance of the UV sensor is known to degrade over time. It can therefore be important to monitor the performance or "health" of the UV sensor to identify when performance of the sensor degrades. One mode of failure is the state where the current flow across the two electrodes occurs spontaneously without the presence of the ultraviolet light from the flame. In this case the sensing tube is indicating the presence of a flame when in fact no flame is present. This condition is commonly referred to in the industry as "run-on". A drawback for flame detector tubes that use photoemission for a metal surface followed by a discharge is that the when the tubes degrade they can fail do to run-on. Run-on is the condition in which the tube keeps firing even after ultraviolet light is not present.

In an effort to address the foregoing difficulties, it is believed that additional electrodes that are sensitive to a breakdown condition can be utilized to detect run-on conditions.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for improved sensor methods and systems.

It is another aspect of the present invention to provide for improved ultra violet flame sensor for detecting run-on conditions.

The aforementioned aspects and other objectives and advantages can now be achieved as described herein. A UV flame sensor for detecting a run-on condition in a flame detector tube is disclosed. The sensor comprises a pair of secondary electrodes that are enclosed in a mesotube to form a breakdown chamber in order to detect run-on conditions. These secondary electrodes are exposed to UV through an aperture in a cathode plate and are energized continuously by a lower voltage. The mesotube is expected to breakdown when a run-on condition occurs of. The secondary electrodes can be placed in the same gas environment as the primary electrodes that may take different forms, shapes and locations.

Secondary electrodes can be placed into the mesotube that are not related to the normal function of the primary electrodes. The lower voltage can be applied to the secondary electrodes and current can be obtained from the breakdown when UV light is present. The secondary electrodes can be exposed to UV, which get discharged when run-on condition occurs. Another mode of operation is that the secondary electrodes not exposed to UV and the run-on condition can be determined by identifying the discharge when UV light is detected. The secondary electrodes are located at greater distance so as not to discharge until hydrogen levels decrease to a 'dead' level.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
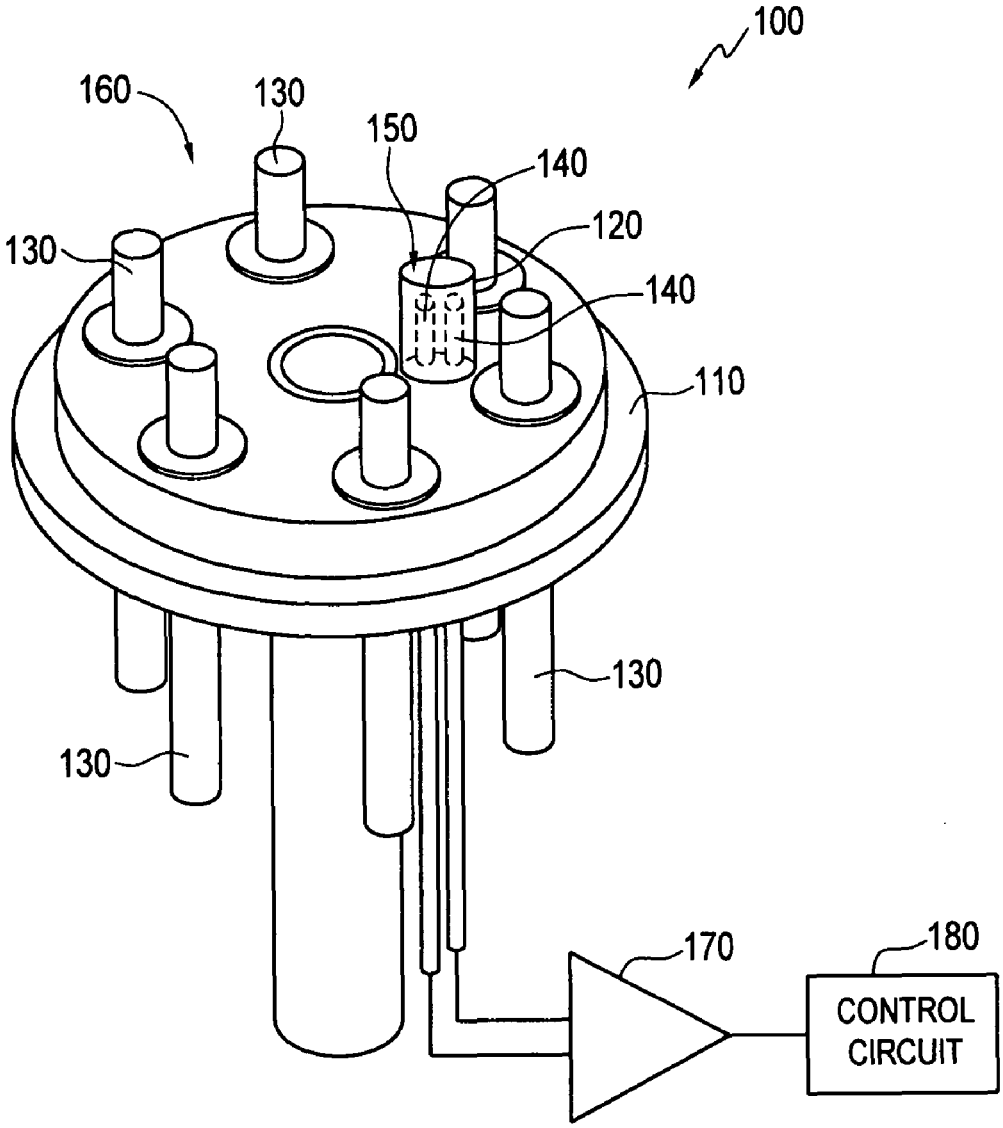
FIG. 1 illustrates a perspective view of an UV flame sensor, which can be adapted for use in implementing a preferred embodiment.

Ultra-violet sensors do not actually come in contact with the flame in a burner as do flame rod electrodes. The Ultra violet flame sensor detects the ultraviolet light, radiated from a flame but is insensitive to other ranges of emitted light such as visible or infrared light. Referring to FIG. 1 a perspective view of a UV flame sensor 100 is illustrated, which can be adapted for use in implementing a preferred embodiment. The UV flame sensor 100 comprises of an UV tube 160, which includes primary electrodes 130, mesotube 120 that is placed on a flange 110. The mesotube 120 further includes secondary electrodes 140 that form a breakdown chamber 150 in order to detect the run-on condition. The UV flame sensor 100 is made of quartz and is filled with a gas that ionizes when struck by UV radiation (not shown) from the flame. In the absence of UV radiation, the gas acts as an insulator between primary electrodes 130, which are mounted inside the tube 160. A high voltage energizes these primary electrodes 130 and lower voltage energizes the secondary electrodes 140 continuously. During combustion, UV radiation ionizes the gas, causing current pulses to flow between the primary electrodes 130. These current pulses result in a flame signal, which are transmitted to an amplifier 170 in the control LCR 180 where it is processed to energize or hold in the flame relay.

Figure 2:
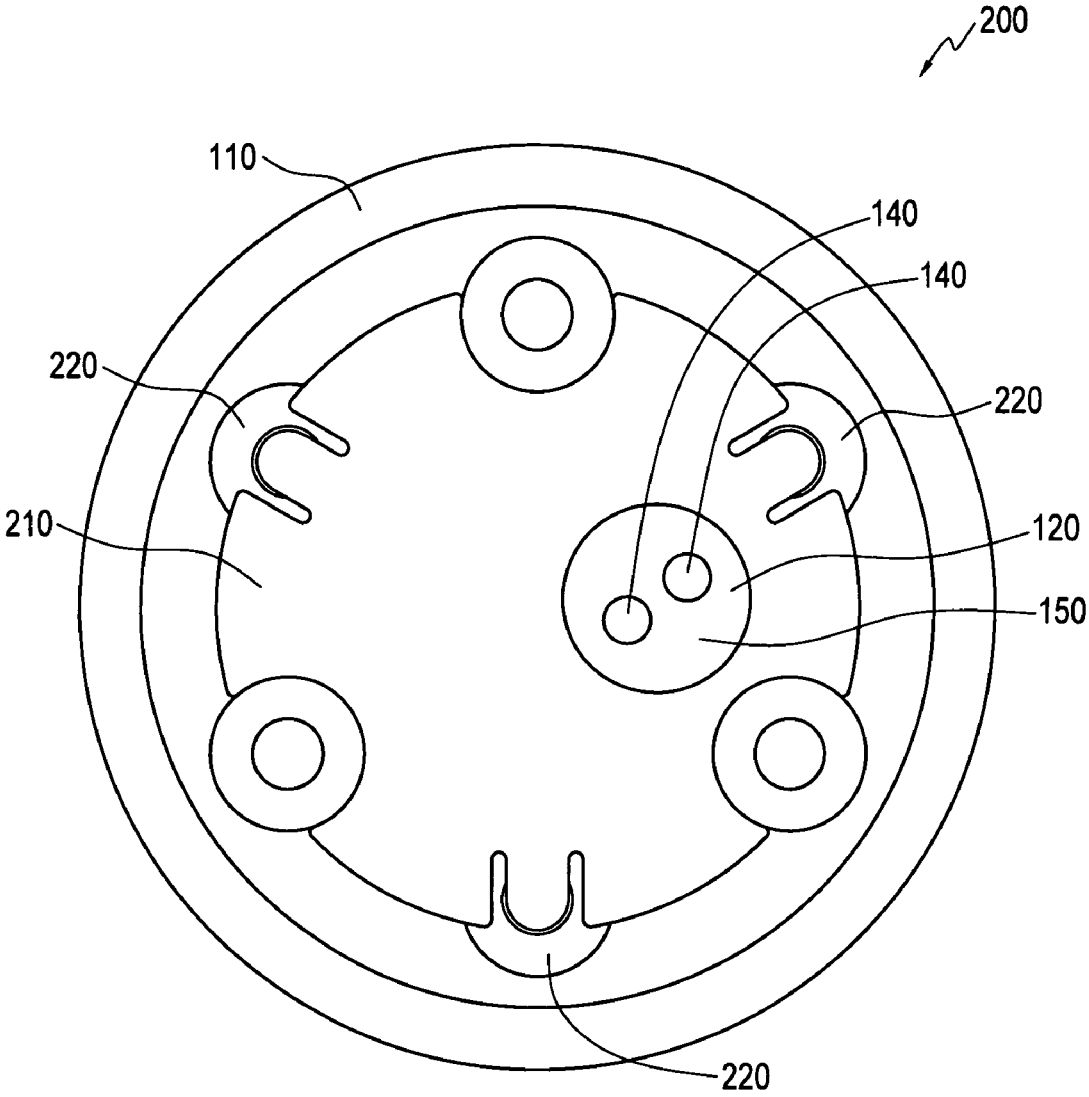
FIG. 2 illustrates a top view of a cathode plate situated on a package flange, in accordance with a preferred embodiment.

Referring to FIG. 2 a top view 200 of a cathode plate 210 situated on the UV flame sensor 100 is illustrated, in accordance with a preferred embodiment. Note that in FIGS. 1-4, identical or similar parts or elements are generally indicated by identical reference numerals. The cathode plate 210 is situated on the flange 110 making contact with a first set of primary electrodes 220. An electrical connection to the cathode plate 210 is made through the first set of primary electrodes 220.

Figure 3:
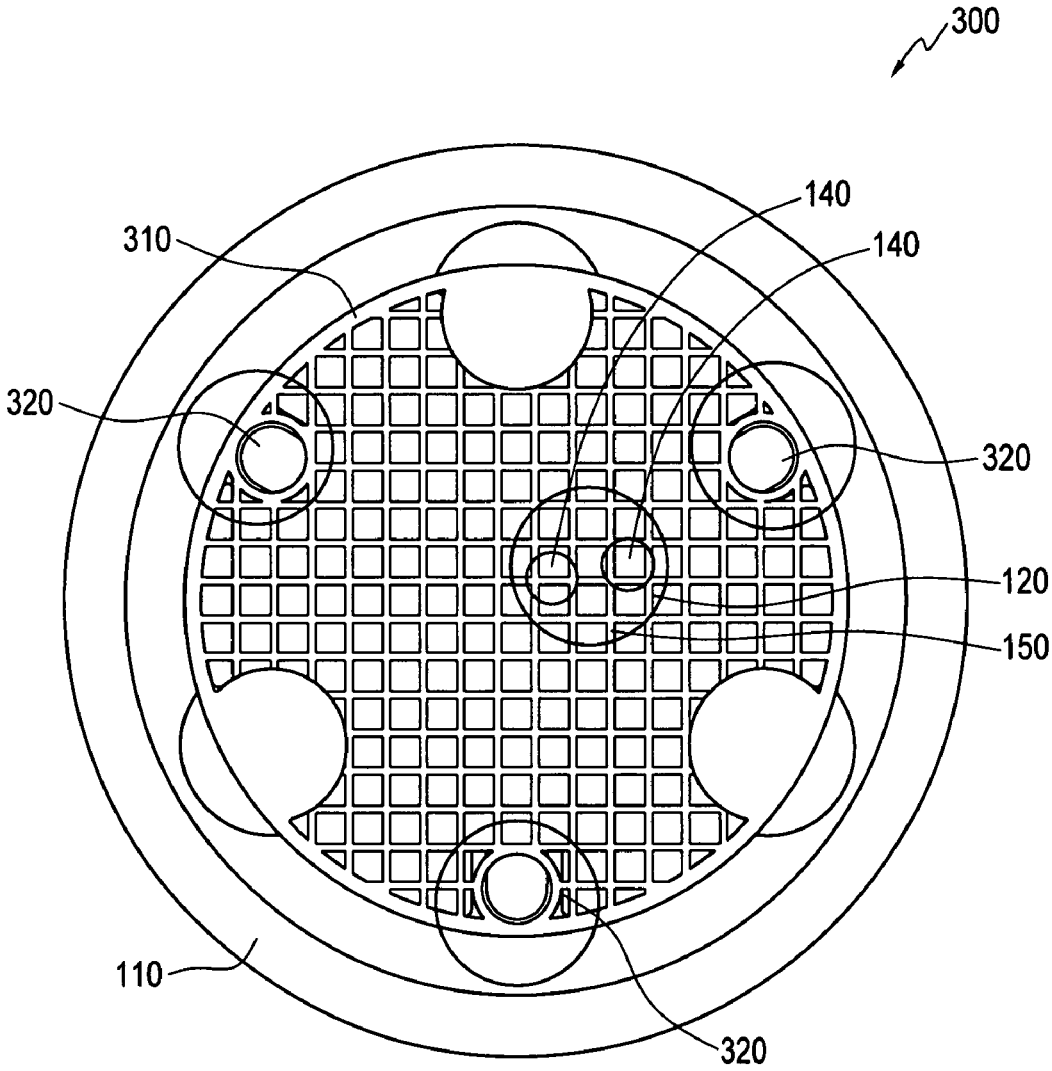
FIG. 3 illustrates a top view of an anode grid situated on the package flange, in accordance with a preferred embodiment.

Referring to FIG. 3 a top view 300 of an anode grid 310 situated over the cathode plate 210 as shown in FIG. 2 on the UV flame sensor 100 is illustrated, in accordance with a preferred embodiment. The anode grid 310 is situated on the flange 110 making contact with a second set of primary electrodes 320. The cathode plate 210 emits electrons when exposed to ultraviolet rays, as from the flame. The electrons are accelerated from a negatively charged cathode plate 210 to the anode grid 310 charged to the discharge starting voltage and ionizing the gas filled the UV tube 160 by colliding with molecules of the gas, generating both negative electrons and positive ions. The electrons are attracted to the anode grid 310 and the ions to the cathode plate 210, generating secondary electrons. A gas discharge avalanche current flows between cathode plate 210 and anode grid 310. The cathode plate 210 and anode grid 310 are situated apart and are approximately parallel with each other. An electrical connection to the anode grid 310 may be made through the second set of primary electrodes 320.

Figure 4:
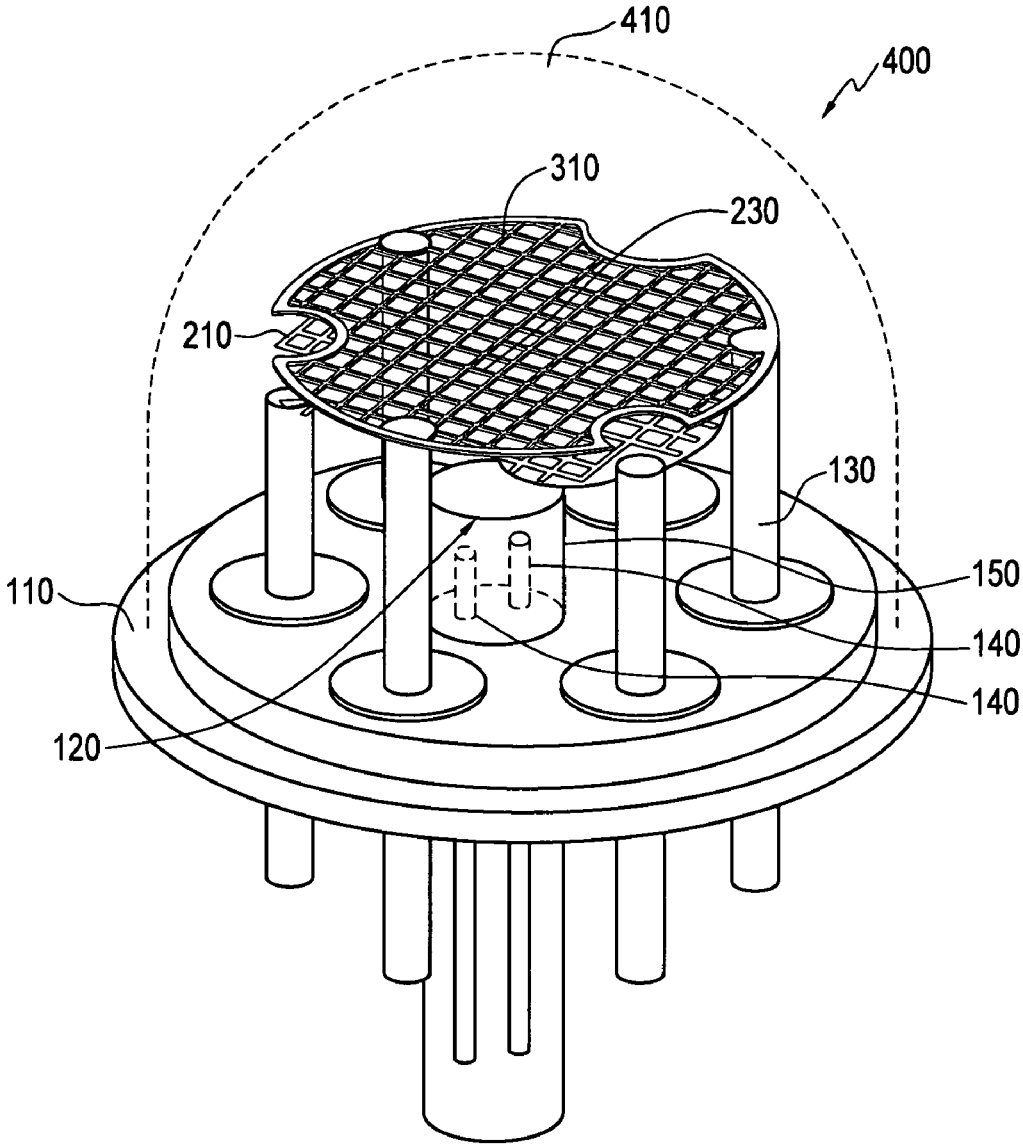
FIG. 4 illustrates an exemplary view of the UV flame sensor for detecting the run-on condition, which can be utilized in accordance with the preferred embodiment.

Referring to FIG. 4 an exemplary view of the UV flame sensor 400 for detecting the run-on condition is illustrated, which can be utilized in accordance with the preferred embodiment. Note that in FIGS. 1-4, identical or similar parts or elements are generally indicated by identical reference numerals. An enclosure 410 such as dome shaped glass, can be situated on the flange 110, which hermetically seals the cathode plate 210 and said anode grid 310 from the ambient environment external to the enclosure. A high voltage is applied across the primary electrodes 130. When the sensor 400 becomes exposed to Ultraviolet radiation in the presence of voltage across the primary electrodes 130, electrons are emitted from the cathode plate 210. The secondary electrodes 140 that are enclosed in the mesotube 120 forms a breakdown chamber 150 in order to detect the run-on condition. These secondary electrodes 140 are exposed to UV through an aperture 230 in the cathode plate 210 and are energized continuously by a lower voltage. These electrons ionize the gas in the mesotube 120 and the gas becomes conductive. Current then begins to flow across the primary electrodes 130 and secondary electrodes 140 and the voltage potential drops.

When the voltage potential drops far enough the conduction stops. This causes the voltage to rise again. If Ultraviolet light is still present from the flame the conduction process will start again when the voltage has risen far enough. This continual sequence results in a series of pulses emitted from the sensor 100 when the flame is present. This series of pulses is then detected as a flame present signal by the burner control. The mesotube 120 is expected to break down when run-on condition occurs. The secondary electrodes 140 can be placed in the same gas environment as the primary electrodes 130 that may take different forms, shapes and locations. The secondary electrodes 140 can be placed into the mesotube 120 that are not related to the normal function of the primary electrodes 130. The secondary electrodes 140 can be exposed to UV without discharging until run-on condition occurs. Another mode of operation is that the secondary electrodes 140 not exposed to UV and the run-on condition can be determined by identifying the discharge when UV light is detected. The secondary electrodes 140 are located at greater distance so as not to discharge until hydrogen levels decrease to a 'dead' level.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A UV flame sensor for detecting a run-on condition in a UV tube, comprising:

a mesotube situated on a flange containing at least one secondary electrode thereby forming a breakdown chamber in order to detect a run-on condition;

a cathode plate situated on said flange and in contact with at least one primary electrode; and an anode grid situated on said flange and in contact with said at least one primary electrode.

2. The UV flame sensor of claim 1 further comprising:

an aperture formed on said cathode plate in order to expose said at least one secondary electrodes to an UV radiation in order to energize said at least one secondary electrode continuously by a lower voltage.

3. The sensor of claim 2, wherein said cathode plate and said anode grid are approximately parallel with each other.

4. The UV flame sensor of claim 1 further comprising:

an enclosure situated on said flange, wherein said enclosure hermetically seals said cathode plate and said anode grid from the ambient environment external to said enclosure and is filled with a gas.

5. The sensor of claim 1, wherein said mesotube is adapted to enter into a breakdown condition when a run-on condition occurs.

6. The sensor of claim 1, wherein said at least one secondary electrode is sensitive to said breakdown condition.

7. The sensor of claim 1, wherein said anode grid comprises a grid form.

8. The sensor of claim 1 further comprising:

a first set of primary electrodes making electrical contact with said cathode plate; and a second set of primary electrodes making electrical contact with said anode grid.

9. The sensor of claim 1, wherein said at least one secondary electrode is placed within said sensor to discharge when hydrogen reaches a predetermined level.

10. A UV flame sensor for detecting run-on conditions in a UV tube, comprising:

a mesotube situated on a flange containing at least one secondary electrode thereby forming a breakdown chamber in order to detect a run-on condition;

a cathode plate situated on said flange and in contact with at least one primary electrode;

an aperture formed on said cathode plate adapted to expose said at least one secondary electrodes to an UV radiation in order to energize said at least one secondary electrode continuously by a lower voltage; and an anode grid situated on said flange and in contact with said at least one primary electrode.

11. The UV flame sensor of claim 10 further comprising:

an enclosure situated on said flange, wherein said enclosure hermetically seals said cathode plate and said anode grid from the ambient environment external to said enclosure and is filled with a gas.

12. The sensor of claim 10, wherein said cathode plate and said anode grid are approximately parallel with each other.

13. The sensor of claim 10, wherein said mesotube is adapted to enter into a breakdown condition when a run-on condition occurs.

14. The sensor of claim 10, wherein said at least one secondary electrode is sensitive to said breakdown condition.

15. The sensor of claim 10, wherein said anode grid comprises a grid form.

16. The sensor of claim 10, further comprising:

a first set of primary electrodes making electrical contact with said cathode plate; and a second set of primary electrodes making electrical contact with said anode grid.

17. The sensor of claim 10, wherein said at least one secondary electrode is placed within said sensor to discharge when hydrogen reaches a predetermined level.

18. The sensor of claim 17, wherein said cathode plate and said anode grid are approximately parallel with each other.

19. The sensor of claim 10, further comprising:

a first set of primary electrodes making electrical contact with said cathode plate; and a second set of primary electrodes making electrical contact with said anode grid.

20. A UV flame sensor for detecting run-on conditions in a UV tube, comprising:

a mesotube situated on a flange containing at least one secondary electrode thereby forming a breakdown chamber in order to detect a run-on condition;

a cathode plate situated on said flange and in contact with at least one primary electrode;

an aperture formed on said cathode plate adapted to expose said at least one secondary electrodes to an UV radiation in order to energize said at least one secondary electrode continuously by a lower voltage;

an anode grid further comprised of a grid form situated on said flange and in contact with said at least one primary electrode; and an enclosure situated on said flange, wherein said enclosure hermetically seals said cathode plate and said anode grid from the ambient environment external to said enclosure and is filled with a gas;

wherein said mesotube is adapted to enter into a breakdown condition when a run-on condition occurs, said at least one secondary electrode is sensitive to said breakdown condition, said at least one secondary electrode is placed within said sensor to discharge when hydrogen reaches a predetermined level.

* * * * *